US008322441B2

(12) United States Patent
Fenton

(10) Patent No.: US 8,322,441 B2
(45) Date of Patent: Dec. 4, 2012

(54) OPEN WATER RECOVERABLE DRILLING PROTECTOR

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 515 days.

(21) Appl. No.: 12/501,057

(22) Filed: Jul. 10, 2009

(65) Prior Publication Data

US 2010/0006301 A1 Jan. 14, 2010

Related U.S. Application Data

(60) Provisional application No. 61/079,636, filed on Jul. 10, 2008.

(51) Int. Cl.
*E21B 23/00* (2006.01)

(52) U.S. Cl. ..... 166/368; 166/339; 166/351; 166/365; 405/158

(58) Field of Classification Search ..... 166/368, 166/338–340, 351, 352, 365, 377, 85.1; 405/158
See application file for complete search history.

(56) References Cited

U.S. PATENT DOCUMENTS 3,473,608 A * 10/1969 Castille Ignace ..... 166/85.3
4,591,197 A * 5/1986 Akkerman ..... 294/86.24
4,625,381 A * 12/1986 Gravouia et al. ..... 29/283
4,995,458 A * 2/1991 Garbett ..... 166/85.3
5,044,438 A * 9/1991 Young ..... 166/382
5,069,287 A * 12/1991 Short et al. ..... 166/339
5,088,556 A * 2/1992 Short et al. ..... 166/339
5,791,418 A * 8/1998 Milberger et al. ..... 166/368
6,302,211 B1 * 10/2001 Nelson et al. ..... 166/348
6,615,923 B1 * 9/2003 Lay et al. ..... 166/368
6,719,044 B2 * 4/2004 Ford et al. ..... 166/85.3
6,749,018 B1 * 6/2004 Ford et al. ..... 166/85.3
6,766,861 B2 * 7/2004 Koen et al. ..... 166/345
6,945,325 B2 * 9/2005 Ford et al. ..... 166/85.3
6,966,381 B2 * 11/2005 Stjernstrom et al. ..... 166/337
7,028,777 B2 * 4/2006 Wade et al. ..... 166/343
7,284,616 B2 * 10/2007 Williams et al. ..... 166/381
8,028,752 B2 * 10/2011 Richards ..... 166/339
8,056,633 B2 * 11/2011 Barra et al. ..... 166/298
8,056,634 B2 * 11/2011 Spencer ..... 166/341
2003/0192704 A1 10/2003 Ford et al.

OTHER PUBLICATIONS

UKIPO Search Report dated Aug. 21, 2009, 3 pages, GB0912029.6.

* cited by examiner

*Primary Examiner* — Matthew Buck
(74) *Attorney, Agent, or Firm* — Bracewell & Giuliani LLP

(57) ABSTRACT

A method and system for retrieving a wear bushing from within a subsea wellhead assembly. The system includes a retrieval tool deployable on a wireline that inserts within the bushing. Latches on the tool radially project outwards and mate with a groove on the bushing inner surface. A hydraulically actuated jack is included with the tool and projects downward to the wellhead assembly to pull the bushing from its temporary coupling in the wellhead assembly. A remotely operated vehicle can be used to assist deploying the tool and for supplying hydraulics and/or control for operating the latch and the jack.

12 Claims, 7 Drawing Sheets

OPEN WATER RECOVERABLE DRILLING PROTECTOR

CROSS REFERENCE TO RELATED APPLICATIONS

This application claims priority to and the benefit of U.S. Provisional Application Ser. No. 61/079,636, filed Jul. 10, 2008, the full disclosure of which is hereby incorporated by reference herein.

FIELD OF THE INVENTION

This invention relates in general to production of oil and gas wells, and in particular to a wellhead assembly having a selectively removable wear bushing.

DESCRIPTION OF RELATED ART

Systems for producing oil and gas from subsea wellbores typically include a subsea wellhead assembly that includes a wellhead housing attached at a wellbore opening, where the wellbore extends through one or more hydrocarbon producing formations. Casing and tubing hangers are landed within the housing for supporting casing and production tubing inserted into the wellbore. The casing lines the wellbore, thereby isolating the wellbore from the surrounding formation. Tubing typically lies concentric within the casing and provides a conduit for producing the hydrocarbons entrained within the formation.

Wellhead assemblies also typically include a production tree connecting to the upper end of the wellhead housing. The production tree controls and distributes the fluids produced from the wellbore. Valve assemblies are typically provided within wellhead production trees for controlling the flow of oil or gas from a wellhead and/or for controlling circulating fluid flow in and out of a wellhead. Gate valves and other sliding stem-type valves have a valve member or disc and operate by selectively moving the stem to insert/remove the valve member into/from the flow of fluid to stop/allow the flow when desired.

In some techniques, the operator runs drill pipe through portions of a production tree and drills the well deeper before the well is completed. The production tree has internal sealing surfaces that could be damaged by the rotating drill pipe. To avoid damage, the operator will install a drilling protector, also called "wear bushing", which is a sleeve that fits within the inner diameter of the production tree. After reaching total depth, the operator retrieves the wear bushing, typically by using the string of drill pipe. The operator may then run a string of tubing and land the tubing hanger in the production tree or a wellhead housing that supports the production tree. Retrievable wear bushings are also employed when drilling through other subsea wellhead members, such, as a wellhead housing. Normally, a riser will connect to the wellhead member, such as the tree or wellhead housing, and the operator runs and retrieves the drill pipe and wear bushing through the riser.

SUMMARY OF INVENTION

A method and system for retrieving a wear bushing from within a subsea wellhead assembly. The method includes providing a retrieval tool having a selectively extendable jack member and a selectively activatable bushing latch, with the bushing latch, coupling the retrieval tool with the bushing, and extending the jack member from the tool and pushing it against the wellhead assembly, so that the retrieval tool and the bushing are urged away from the wellhead assembly together. In one example, engaging the bushing latch is accomplished with the bushing. The bushing can include a recess on its inner surface and the bushing latch can be on a portion of the retrieval tool insertable into the bushing and configured to selectively extend radially outward from the retrieval tool and register with the recess, thereby coupling the retrieval tool and bushing. In one example, the jack member can be substantially parallel with the bushing axis so it contacts the wellhead assembly lateral to the bushing outer periphery. The jack member can be disposed on a portion of the retrieval tool having an outer periphery that is greater than the bushing outer periphery. After latching the retrieval tool to the bushing, the method can further include raising the retrieval tool and bushing from subsea. A remotely operated vehicle (ROV) can optionally be deployed subsea and operatively coupled to the retrieval tool and used to operate the retrieval tool. The bushing can be a wear bushing and the bore can be a main bore of the wellhead assembly. In one example of use, the bushing can be temporarily retained within the bore by a ring set in grooves respectively formed on the bushing outer surface and bore inner surface and wherein the grooves are at least partially registered with one another.

Also disclosed herein is a method of completing a well subsea. In this example the method includes providing on the seafloor a wellhead member having a main bore and a wear bushing coupled within the main bore, landing a retrieval tool onto the wellhead member having a portion on the wellhead member and outside of the main bore periphery and latching the retrieval tool to the wear bushing, decoupling the wear bushing from the main bore by applying a separating force on both the wellhead member and retrieval tool, removing the wear bushing from within the main bore, landing tubulars within the main bore, and landing a production tree onto the wellhead member. A drill string can be inserted through the main bore and wear bushing and used for drilling a well into the seafloor. In one example, the retrieval tool can have an upper portion whose outer periphery contacts an upper surface of the wellhead member that circumscribes the main bore; the tool may include an attached lower portion insertable within the wear bushing. A groove may be included in the wear bushing that circumscribes its inner surface. A latch can be included on the tool lower portion that selectively projects radially outward; thus in one example the latching the retrieval tool to the wear bushing is accomplished by projecting the latch into registration with the groove. A jack member can be provided on the retrieval tool that is selectively extendable from its upper portion. Separating the bushing from the main bore may involve extending the jack member from the upper member to push it against the wellhead member apply the separating force. A remotely operated vehicle (ROV) can be coupled with the retrieval tool for operating the retrieval tool.

Further described herein is a retrieval tool useful for retrieving a wear bushing from within a subsea wellhead member. The tool can include an upper portion for engagement by a lift line for landing on an upper end of the wellhead member, a lower portion depending from the upper portion and having an smaller outer periphery than the upper portion for insertion into the wellhead member, an elongated jack member selectively projectable from the upper portion and into an orientation substantially parallel with the lower portion axis, and a latch selectively extendable from the lower portion, so that when the retrieval tool is in a retrieval configuration with the lower portion inserted within the wear bushing, the latch engaged with the wear bushing, and the jack member is selectively projected from the upper portion, the jack member pushes against the wellhead member to move the retrieval tool away from the wellhead member and slide the wear bushing from within the wellhead member. The tool can include on it a remotely operated vehicle connection in communication with the latch and jack member. In one example of use, the latch is configured to engage a groove formed on the wear bushing inner surface.

BRIEF DESCRIPTION OF THE DRAWINGS

Some of the features and benefits of the present disclosure having been stated, others will become apparent as the description proceeds when taken in conjunction with the accompanying drawings, in which.

While the subject device and method will be described in connection with the preferred embodiments but not limited thereto. On the contrary, it is intended to cover all alternatives, modifications, and equivalents, as may be included within the spirit and scope of the present disclosure as defined by the appended claims.

DETAILED DESCRIPTION OF THE INVENTION

Figure 1:
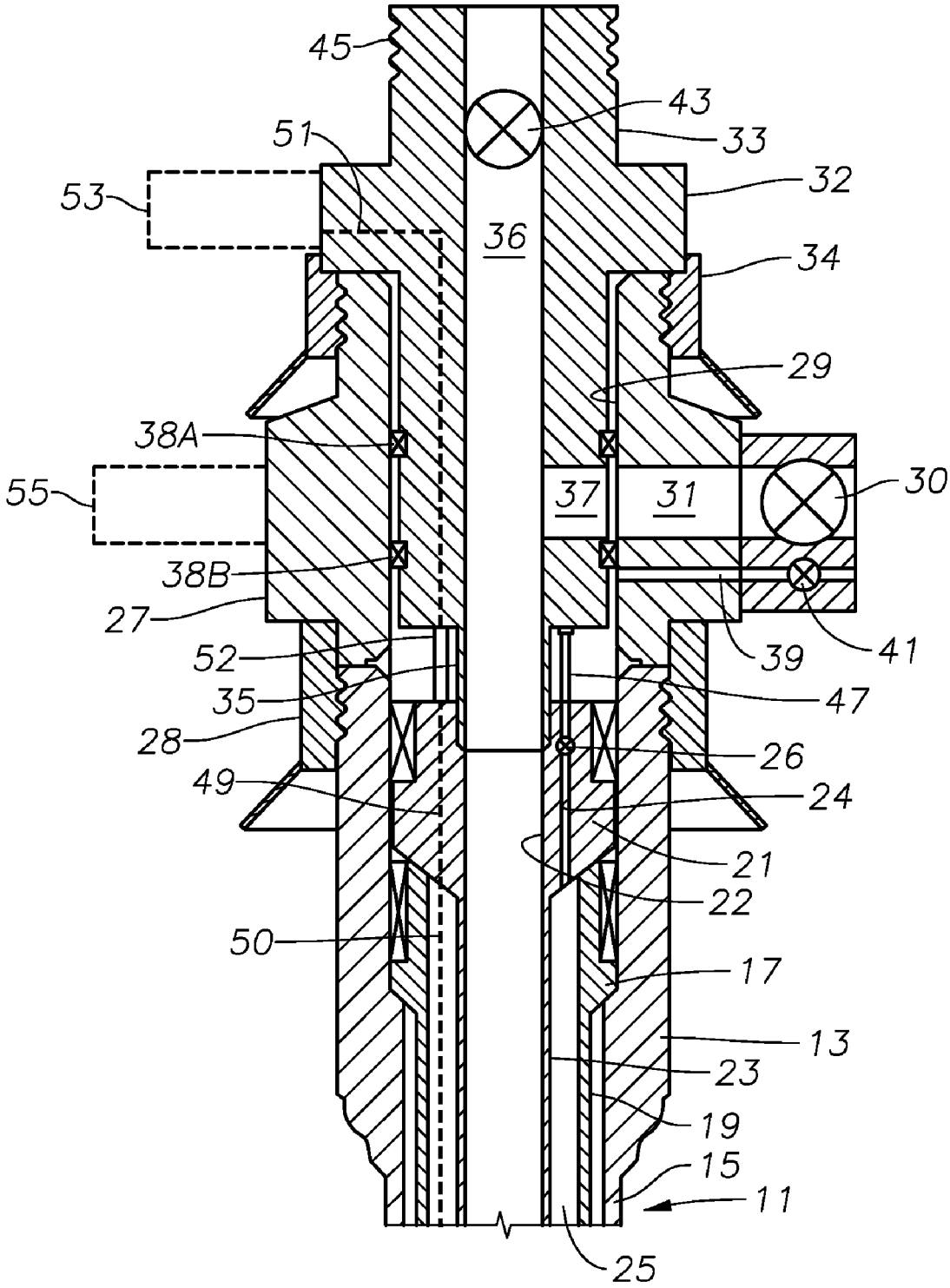
FIG. 1 is schematic sectional view of a subsea wellhead assembly constructed in accordance with the present disclosure.

FIG. 1 shows in a side sectional view a wellhead housing 13 with a conductor casing 15 depending to a predetermined depth within a subsea well 11. A casing hanger 17 is landed within wellhead housing 13 with a string of casing 19 extending therefrom to another predetermined depth within subsea well 11. Also landed within wellhead housing 13 is a tubing hanger 21; a tubing string 23 is shown within the casing string 19 and supported on its upper end by the tubing hanger 21. In one example, the tubing string 23 extends to a production depth for receiving well fluid from within subsea well 11. Tubing hanger 21 has an axially extending production flow passage 22. A tubing annulus 25 is defined between the interior surface of string of casing 19 and the exterior surface of string of tubing 23. Tubing hanger 21 optionally may have a tubing annulus passage 24 extending axially through it offset from and parallel to production flow passage 22. In addition, a tubing annulus valve 26 may be located within tubing annulus passage 24 for opening and closing passage 24. In one embodiment, tubing annulus valve 26 is biased by a spring to a closed position. Tubing hanger 21 is rotated or oriented to a desired orientation relative to wellhead housing 13. Orientation may be accomplished in a variety of known ways.

A production tree or spool 27 lands on and connects to an upper end portion of wellhead housing 13. A schematically illustrated external connector 28 connects the spool 27 and wellhead housing 13. Spool 27 and wellhead housing have a bore 29 extending axially therethrough that has a diameter at least equal to the outer diameter of tubing hanger 21. This allows the tubing hanger 21 to be retrieved through spool 27. Optionally, bore 29 may be as at least as large as the portion of the bore of wellhead housing 13 above casing hanger 17 to allow casing hanger 17 to be installed through spool 27. An outlet port 31 is shown extending through a side wall of spool 27 The outlet port 31 can be used for the flow of production fluids from tubing 23. At least one outlet valve 30 is mounted to the exterior of spool 27 to control the flow of well fluids exiting spool 27 through outlet port 31. Well fluids flowing through outlet valve 30 may be delivered by methods known to those skilled in the art to a subsea collection manifold or to a platform located at the surface.

A tree cap 33 is illustrated having a lower cylindrical portion that is closely received within bore 29 of spool 27. Tree cap 33 may either connect to spool 27 internally or externally as shown. In this embodiment, tree cap 33 has an external flange 32 that lands on the rim or upper end of spool 27. An external connector 34 connects tree cap 33 to a profile formed on the upper portion of spool 27.

Tree cap 33 has an axially extending production passage 36. An isolation tube 35 is secured to the lower end of tree cap 33. Isolation tube 35 extends downward and stabs into sealing engagement with production passage 22 in tubing hanger 21. An outlet opening 37 extends laterally from production passage 36 through a sidewall of tree cap 33 to allow fluid flow to spool outlet port 31. Upper and lower seals 38A, 38B extend around tree cap 33 and sealingly engage spool bore 29 above and below outlet port 31. In this embodiment, upper seal 38A is the uppermost pressure barrier that seals to bore 29.

A tubing annulus access port 39 extends through a sidewall of spool 27 below lower seal 38B for registering with and monitoring annulus 25. Tubing annulus access port 39 is in communication with spool bore 29 below lower seal 38B. A valve 41 is mounted to the exterior of tubing annulus access port 39 for opening and closing port 39.

Tree cap 33 has a valve 43 above lateral flow outlet 37 for opening and closing access to its production passage 36. If desired, a wire line plug profile could be formed in production passage 36 above flow outlet 37 for installing a wire line (or ROV tool installable) plug as a second pressure barrier within production passage 37. Tree cap 33 optionally has a cylindrical mandrel portion above its flange 32 that has a grooved profile 45 for coupling to pressure control equipment, such as a riser or blowout preventer, during wire line or similar workover operations. Tree cap 33 may have an actuator 47 extending downward from its lower end for engaging and opening tubing annulus valve 26. Actuator 47 could be a fixed probe that compresses the spring within tubing annulus valve 26 to cause it to open. Alternately, actuator 47 could be hydraulically extended and retracted.

In this embodiment, tubing hanger 21 has a number of auxiliary passages 49 (only one shown) extending from its lower end to its upper end. Auxiliary passages 49 are used to control downhole safety valves (not shown), to communicate with downhole sensors, and for other functions, such as supplying power to a downhole electrical submersible pump. Auxiliary passage 49 is shown schematically connected to a downhole auxiliary line 50 that extends alongside tubing 23 for supplying hydraulic fluid pressure or electrical or optical signals. Each auxiliary passage 49 has a coupling receptacle on the upper end of tubing hanger 21.

In one embodiment, the tree cap 33 includes mating auxiliary passages 51. A coupling 52 associated with each auxiliary passage 51 depends downward from tree cap 33 and stabs into sealing engagement with one of the auxiliary passages 49 in tubing hanger 21. In this embodiment, the upper ends of at least some of the tree cap auxiliary passages 51 extend to a side of tree cap 33 above spool 27. A controls module 53 having electrical and hydraulic control circuitry mounts to tree cap 33 for supplying hydraulic fluid pressure and electrical power to downhole safety valves and sensors. Controls module 53 may optionally be retrievable from tree cap 33 as well as retrievable along with tree cap 33. Controls module 53 may also control tree cap valve 43, if one is utilized. A separate controls module 55 may be mounted to a side of spool 27 for controlling valves 30. If so, preferably controls module 55 is retrievable from spool 27.

Figure 2:
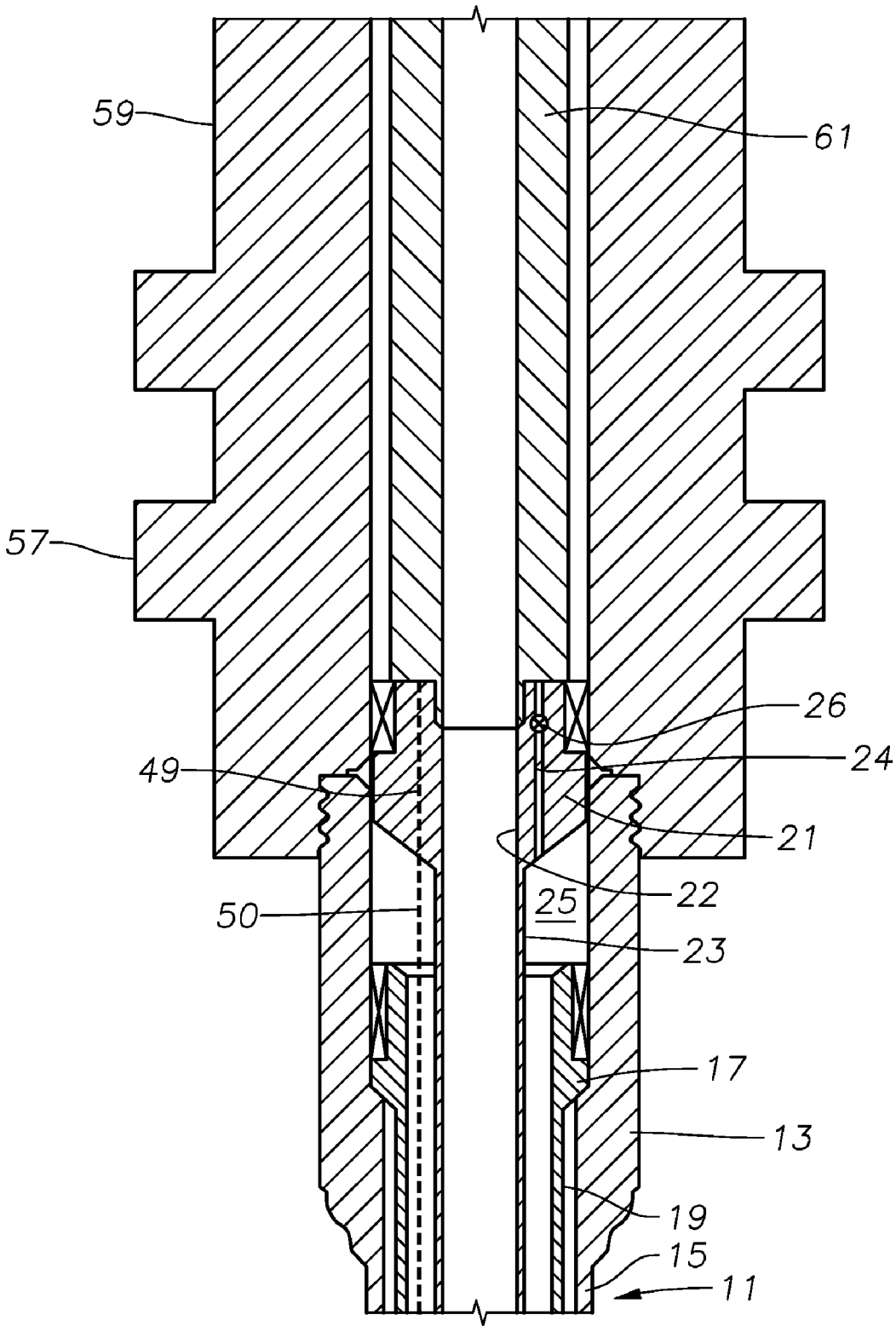
FIG. 2 is a schematic sectional view of a tubing hanger being installed in the subsea wellhead housing of FIG. 1.

In an example of operation, subsea wellhead housing 13 and conductor casing 15 are landed within subsea well 11. As shown in FIG. 2, a blowout preventer assembly ("BOP") 57 is attached to an upper end portion of wellhead housing 13. BOP 57 is a lower part of a string of drilling riser 59 that extends to a drilling vessel. Drilling operations are conventionally conducted through BOP 57 and wellhead housing 13. When at total depth, casing hanger 17 and string of casing 19 are lowered through drilling riser 59 and BOP 57, landed within wellhead housing 13 and cemented into place within the well in a manner known in the art. More than one string of casing may be installed.

Tubing hanger 21 and a string of tubing 23 are then lowered on a running tool 61 and drill string through drilling riser 59 and BOP 57. Tubing hanger 21 is oriented, landed, sealed, and latched conventionally in the bore of wellhead housing 13. For example, the orientation may be with a pin and slot arrangement associated with BOP 57, or a separate orientation spool might be employed. When tubing hanger 21 lands, tubing 23 will extend into the subsea well to a production depth. Normally, the operator will circulate the drilling mud from casing 19 by pumping down tubing annulus 25 and returning fluid up tubing 23, or vice-versa. Running tool 61 can be used to open tubing annulus valve 26 and a downhole safety valve (not shown) to allow circulation to occur. The operator may also perforate and test the well in a conventional manner at this point.

After perforating and testing the well, the operator lowers a temporary plug 63 (FIG. 3) on a wire line through the drill string and running tool 61 and latches it within production passage 22 of tubing hanger 21 to seal subsea well 11. The drilling riser and blowout preventer assembly 57, 59 are then removed from connection with wellhead housing 13. The drilling vessel may also leave the vicinity to drill another well. At this point, the operator can install additional equipment, such as piping on flow lines to a subsea manifold or the surface without BOP 57 and drilling riser 59 being in the way.

Figure 3:
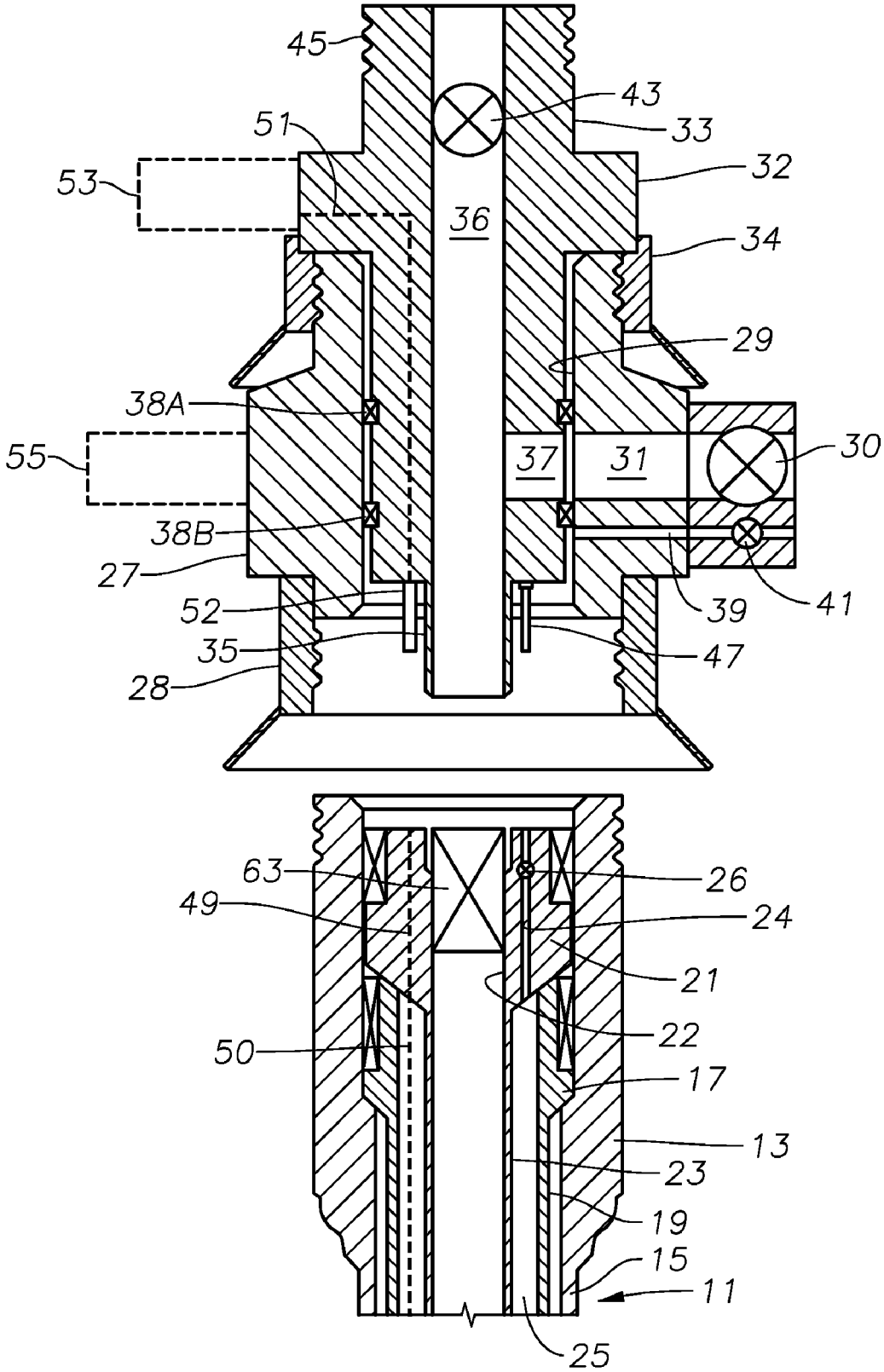
FIG. 3 is a schematic sectional view of a spool and tree cap being installed on the wellhead housing of FIG. 1.

At the surface, the operator assembles tree cap 33 to spool 27 with the desired orientation. The operator subsequently lowers the pre-unitized assembly of tree cap 33 and spool 27, as illustrated in FIG. 3, preferably on a lift line. It is not necessary for the vessel used to lower the assembly to have a derrick or the capability of running drill pipe. The operator orients and lands flow spool 27 complete and pre-unitized with tree cap 33 on an upper end portion of wellhead housing 13. The orientation of spool 27 to wellhead housing 13 may be handled conventionally, such as with the assistance of an ROV (remote operated vehicle) and video cameras. Upon landing, isolation spool 35 stabs into engagement with production passage 22 of tubing hanger 21, thereby defining an axial passage extending from a production depth of subsea well 11 to outlet opening 37 of tree cap 33. Outlet opening 37 aligns with outlet port 31 so that well fluids can flow directly from outlet opening 37 through outlet port 31.

Also, upon landing of spool 27, auxiliary couplings 52 connect auxiliary lines 50 to control module 53 via line 51. In addition, tubing annulus valve actuator 47 stabs into tubing annulus valve 26 and opens it, which places annulus access port 39 in fluid communication with tubing annulus 25. The operator plugs control modules 53, 55 into a subsea umbilical that delivers electrical and hydraulic power and control signals. The operator can then remove plug 63 to initiate well fluid production from subsea well assembly 11. This may be handled with a subsea plug removal tool (such as shown in U.S. Pat. No. 6,719,059) that is lowered on a lift line and attached to tree cap profile 45 with the assistance of an ROV. Upon removing plug 63, the operator opens valve 30 to communicate well fluids from string of tubing 23 to a subsea manifold or to a collection facility located on a surface.

For workover operations through tubing 23, the operator may attach a riser to tree cap 33 and perform operations through tubing 23, such as wire line operations. For a workover operation requiring the retrieval of tubing 23, the operator can install wire line plug 63 back in tubing hanger 21 using a subsea plug retrieval tool, then retrieve tree cap 33 on a lift line. The operator would then attach a workover or drilling riser to spool 27 and pull tubing hanger 21 and tubing 23 in a conventional manner through the workover riser. Prior to pulling tubing hanger 21, the operator would typically render the well safe by "killing" in a routine manner. Well circulation would be in the same manner as during completion, which is via running tool 61, tubing annulus passage 24 in tubing hanger 21 and tubing 23.

If desired, the workover operation may include further drilling, such as drilling a sidetracked portion of the well to a more productive zone. In one method, the operator pulls tubing hanger 21 and production tubing 23 through spool 27 and the workover or drilling riser. The operator would then lower a drill string through the riser and spool 27 and drill a sidetracked portion of the well. The operator would run casing or a liner through the riser and spool 27 into the sidetracked portion and install a string of tubing in the sidetracked portion. The operator would complete the sidetracked portion of the well in the same manner as described above.

Figure 4:
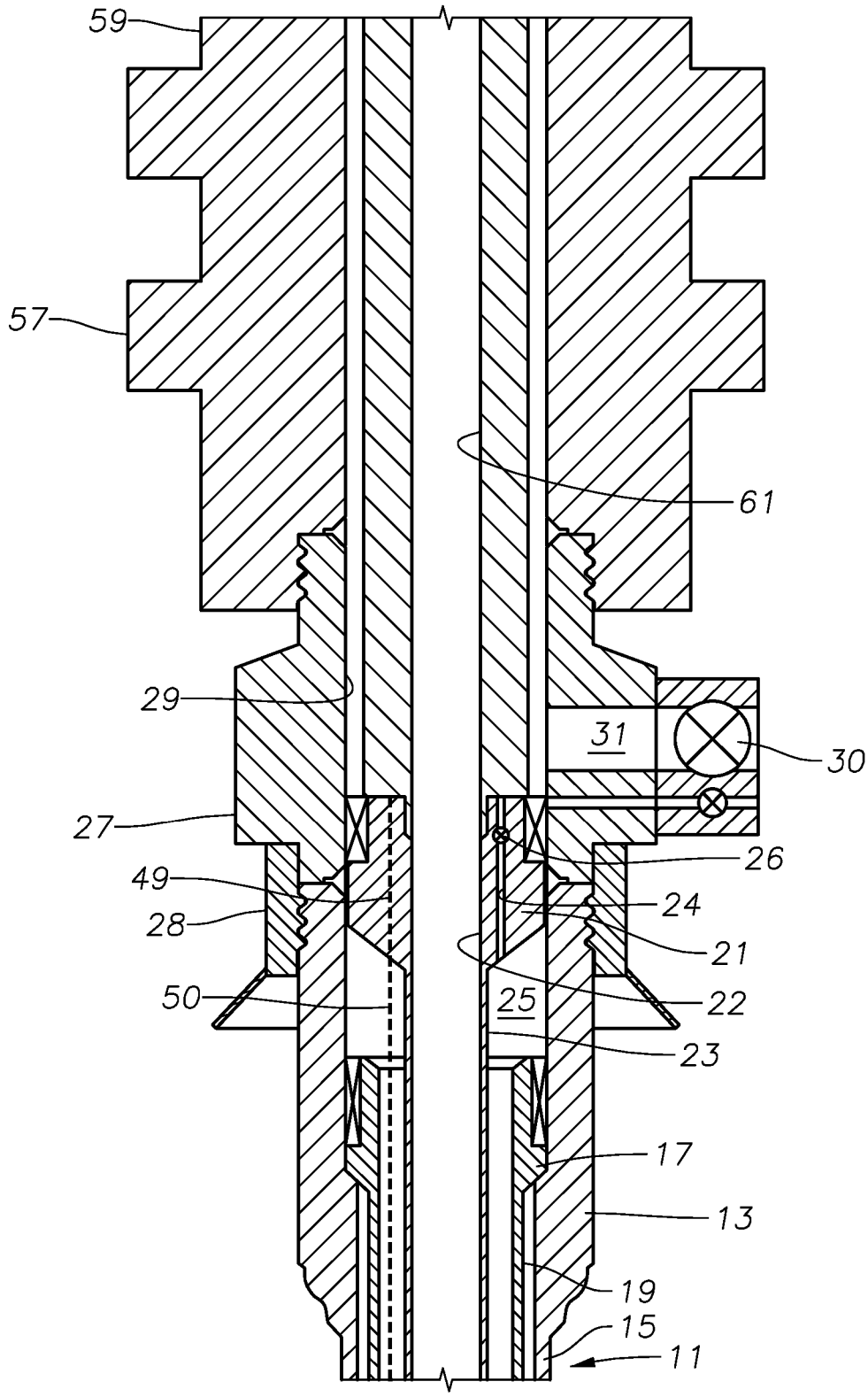
FIG. 4 is a schematic sectional view of the tubing hanger being lowered through the previously installed spool.

FIG. 4 illustrates an alternative embodiment, which involves drilling the well through spool 27. Wellhead housing 13 and conductor casing 15 are installed in a conventional manner as in the first method. After installing wellhead housing 13 and outer casing 15, the operator then orients, lands and connects spool 27 to an upper end portion of wellhead housing 13. Typically spool 27 is installed via a lift line, but it could also be run on a drill string. The operator then lowers the drilling riser 59 and connects BOP 57 with the profile on an upper end portion of spool 27. The operator then continues drilling through BOP 57 and spool 27. Such an operation is also known as "drill through" operations.

Upon drilling subsea well 11 to a desired depth, operator then lowers casing hanger 17 with string of casing 19 attached thereto through drilling riser 59 and BOP 57 and lands, sets and seals casing hanger 17 within wellhead housing 13. The operator then lowers tubing 23 to the production depth of subsea well 11 and lands tubing hanger 21 in wellhead housing 13. The operator completes and tests the well in a conventional manner through the drilling riser and BOP 57. Using a wire line, the operator then lowers plug 63 (FIG. 2) through BOP 57 to sealingly close subsea well 11. The operator then removes drilling riser 59 and BOP 57.

The operator then lowers tree cap 33 (FIG. 1) via a lift line to land within spool 27. As before, isolation tube 35 is attached to tree cap 33 and stabs into sealing engagement with production passage 22 in tubing hanger 21. Tree cap auxiliary passages 51 mate with auxiliary passages 49 in tubing hanger 21. Upon landing tree cap 33 within spool 27, the operator can remove plug 63 from tubing hanger 21 to allow well fluids to flow from a lower end portion of string of tubing 23 to outlet opening 37. The operator then opens valve 30 to allow flow of well fluids from subsea well 11 to a subsea manifold collection manifold or to the surface.

Significant advantages are presented herein. In addition to serving as a pressure barrier, the tree cap 33 provides a communication flow path for the production fluid from the tubing hanger 21 to the production flow outlet in the spool. Completing the well before running the spool, as in another embodiment, allows the drilling rig to moved, if desired, before installing the spool. The spool and tree cap can be assembled as a unit and lowered on a lift line on a vessel that may lack a derrick. In the second embodiment, the well may be drilled to total depth and casing installed through the spool. In both embodiments, for workover operations requiring retrieval of tubing, the tree cap can be pulled without disturbing the spool. Auxiliary lines, such as for downhole sensors and safety valves, may be lead through the tree cap to the exterior of the tree cap above the spool. The control module associated with these functions may be mounted to the tree cap and retrievable along with the tree cap. The controls for the valves of the spool may be in a separate module, if desired, and attached to the spool. Landing the tree cap on the rim of the spool avoids the need for a landing shoulder within the bore of the spool.

Alternate methods of subsea operations are illustrated in FIGS. 5 through 8. A wellhead assembly 10 is shown in a side sectional view in FIG. 5 having spool 27 mounted on top of wellhead housing 13. External connector 28 schematically couples the spool 27 and wellhead housing 13. The wellhead assembly 10 of FIG. 5 includes a drilling protector or wear bushing 70. The wear bushing 70 as shown is an annular member or sleeve coaxially inserted within the bore 29. The wear bushing 70 includes a lower end 71 shown positioned adjacent a radially inwardly directed profile 14 circumscribing the well head housing 13 inner diameter. The profile 14 defines a bore 29 diameter transition and lies in a plane generally orthogonal to the bore 29 axis. The lower end 71 of wear bushing 70 is correspondingly shaped to match the profile 14. As shown, the respective inner diameters of the wear bushing 70 and bore 29 below the profile 14 are substantially the same to minimize an edge from protruding radially inward along the profile 14. Without an edge at the profile 14, a seamless path is provided for tool insertion through the wellhead assembly 10. Moreover, the wear bushing 70 protects the spool 27 and well head housing 13 inner diameter along the bore 29 from potential damage from tools, such as a drill bit and string 75, inserted through the bore 29.

A split ring 18 is shown residing in corresponding channels 12, 72 respectively formed along the inner and outer diameters of the well head housing 13 and wear bushing 70. The split ring 18 axially secures the wear bushing 70 in the bore 29. Optionally, coupling the wear bushing 70 within the bore 29 may be accomplished using an interference 20 comprising corresponding protrusions and indentations. As will be discussed in more detail below, a retrieval channel 73 for removing the wear bushing 70 is shown formed radially along the wear bushing 70 inner diameter near the upper end of wear bushing 70. Other means for coupling the wear bushing 70 within the bore 29 and retrieving the bushing 70 are available and the scope of the present application is not limited to the embodiments illustrated in the figures.

Figure 5:
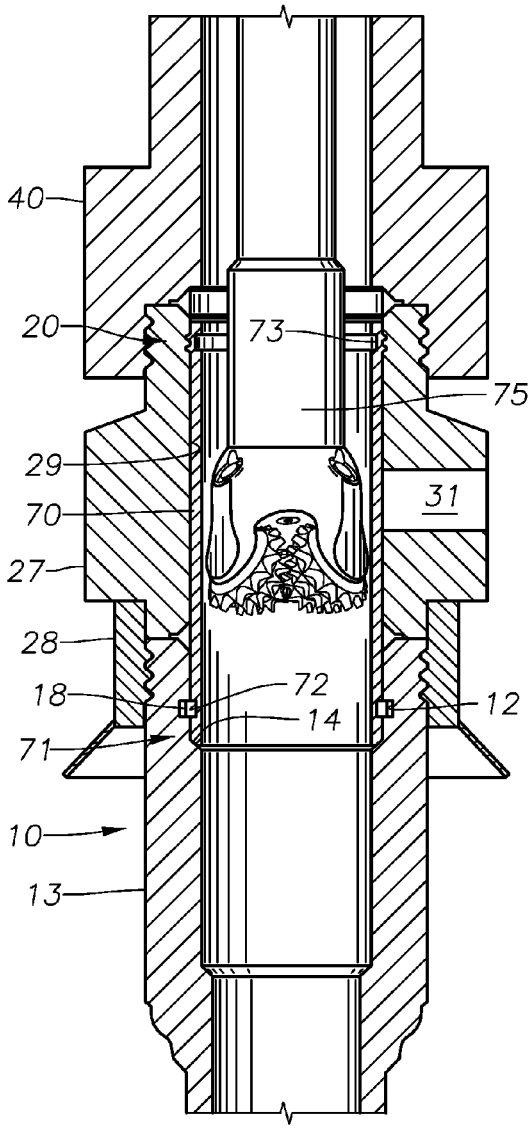
FIG. 5 is a schematic sectional view of a subsea well having a wear bushing.

Included with the embodiment of FIG. 5 is a drilling riser 40, where its lower end is attached to the spool 27 upper terminal end. Drilling riser 40 would normally include a blow out preventer (BOP). The wear bushing 70 may be preinstalled within the bore 29 on the spool 27. If a drill system is used, the wear bushing 70 may be optionally recovered through the drilling riser 40 in a conventional manner, such as with a retrieval fitting attached to a drill string. The wear bushing 70 is recoverable with an ROV after riser 40 is disconnected; the recovery can take place in parallel with retrieving the BOP stack and riser 40.

Figure 6:
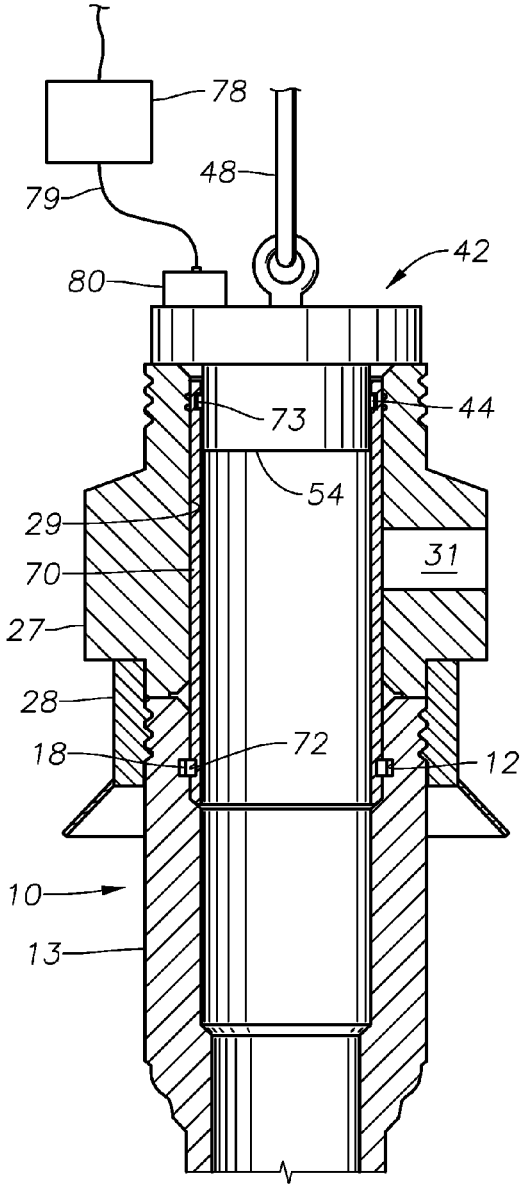
FIG. 6 is a view of the subsea well of FIG. 5 with a recovery tool engaging the wear bushing.
Figure 7:
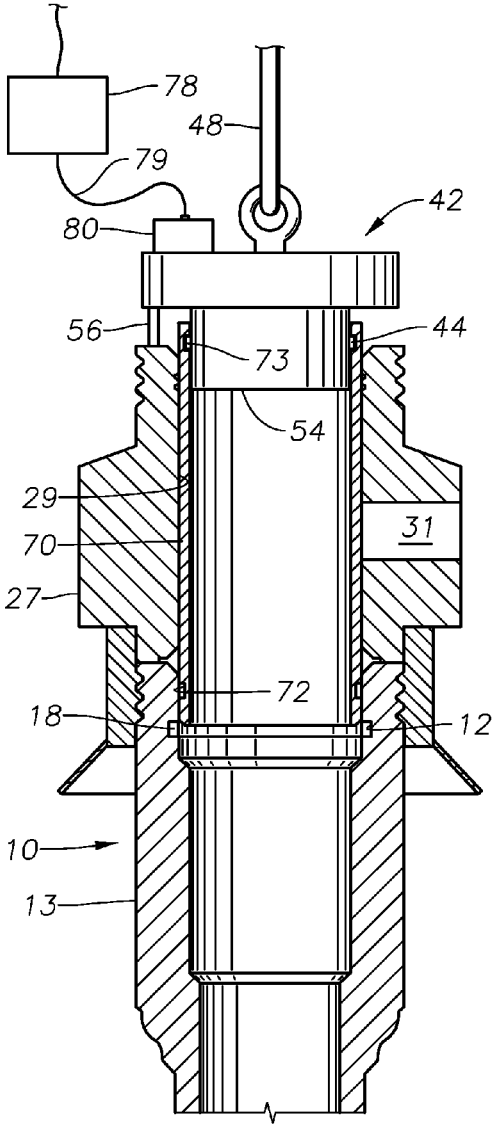
FIG. 7 illustrates a schematic view of the recovery tool of FIG. 6 pulling the wear bushing from the subsea well.
Figure 8:
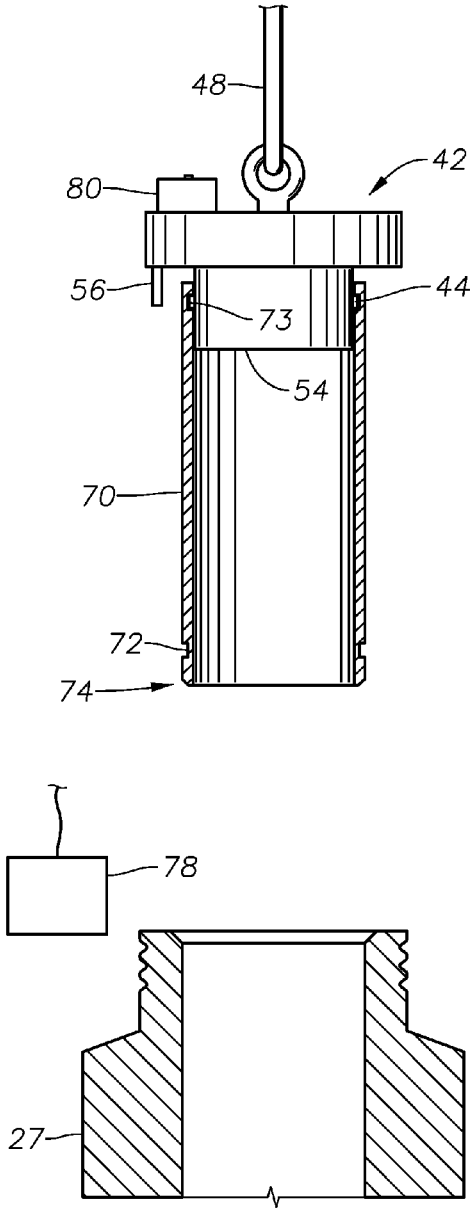
FIG. 8 is a schematic sectional view of the recovery tool engaged with the wear bushing.

FIGS. 6 through 8 depict a method of retrieval of wear bushing 70 from the subsea well 11 after riser 40 has been disconnected. Referring to FIG. 6, a side schematic view is illustrated of a retrieval tool 42 engaging the wear bushing 70. A lift line 48 shown attached to the retrieval tool 42 can be used for raising and lowering the tool 42. The retrieval tool 42 includes an ROV panel or port 80 coupled to a schematically depicted ROV 78 through a line 79. The ROV 78 can be used to assist with deploying the retrieval tool 42. A cylindrical extension 54 downwardly depends from the retrieval tool 42 lower end where it is coaxially inserted within the wear bushing 70 annulus. A latch member 44 is included with the retrieval tool 42 that is selectively extendable radially outward from the extension 54 shown registering with the retrieval channel 73. Latch member 44 extension may be initiated by a hydraulic pressure signal sent from the ROV 78 through the line 79.

Figure 6A:
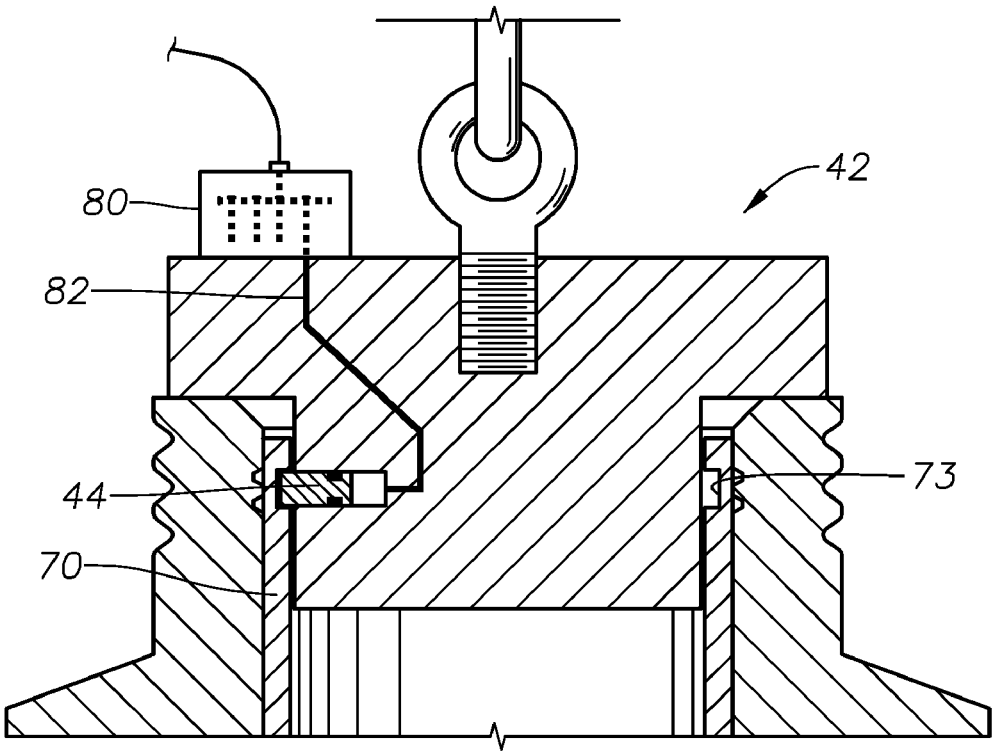
FIGS. 6A and 6B provide in an enlarged view embodiments of the latch member of FIG. 6.
Figure 6B:
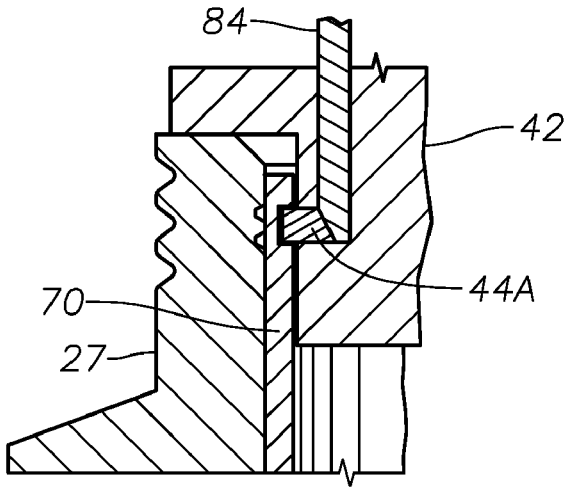

FIG. 6A, which is an enlarged view of a portion of FIG. 6, schematically depicts an embodiment of latch member 44 operation having a hydraulic circuit 82 communicating between the ROV panel 80 and the latch member 44. Inserting the latch member 44 into the retrieval channel 73, couples together the retrieval tool 42 and wear bushing 70. Latch member 44 extension may be initiated by a hydraulic pressure signal sent from the ROV 78 through the line 79. Optionally, as shown in FIG. 6B, the latch member 44A may be a cam ring. An example of a cam ring is provided in Radi, et al., U.S. Pat. No. 6,070,669, issued Jun. 6, 2000 to the assignee of the present application, the contents of which is incorporated by reference herein. A tapered sleeve 84 is pushed downward in response to applied pressurized hydraulic fluid that in turn urges the latch member 44A into the groove 73 for coupling the retrieval tool 42 and wear bushing 70.

As depicted in FIG. 7, a push off jack 56 is urged downward from the tool 42 against the spool 27 upper surface, thereby separating the tool 42 and wear bushing 70 from within the spool 27. Although a single push off jack 56 is shown, two or more push jacks 56 may be included. The force applied by the push off jack 56 against the spool 27 exceeds the retaining force provided from the split ring 18 in the channels 12, 72 as well as that of the interference 20. The push off jack 56 can be hydraulically activated via the ROV 78 and ROV panel 80, such as by directing pressurized hydraulic fluid to the panel 80 from the ROV 78 through the line 79. Optionally, the panel 80 may include a supply or source of pressurized fluid for extending the push off jack 56, and the line 79 carries a signal from the ROV 78 to deploy the push off jack 56. Alternatively, an expander (not shown) can be employed to expand the split ring 18 into the channel 12 formed in the well head housing 13 thereby removing it from the bushing channel 72 and releasing the wear bushing 70 from the wellhead assembly 10. In another alternative, if the interference 20 couples the wear bushing 70 to the bore 29, an overpull from the lift line 48 can unseat the wear bushing 70 from the interference 20 for retrieval.

FIG. 8 is a side schematic sectional view of the wear bushing 70 attached to the retrieval tool 42, where the retrieval tool 42 is suspended on the lift line 48. In this embodiment, the retrieval tool 42 and wear bushing 70 can be in the process of being retrieved from a subsea well, or deployed to a subsea well. The ROV 78 is illustrated proximate the wellhead assembly 11, but could instead be accompanying the retrieval tool 42. In one embodiment, the wear bushing lower end 74 could be made from or coated with a material softer than the material of most or all components of the wellhead assembly 11. Thus inadvertent impacts between the wear bushing 70 and wellhead assembly 11 would likely first deform the softer material, thereby preventing damage to the wellhead assembly 11 and its components. Wellhead components susceptible to damage include gaskets that may be struck by the bushing lower end 74 during retrieval. Examples of softer materials include elastomers, soft metals, and other pliable or otherwise malleable materials.

It should be apparent to those skilled in the art that the present disclosure is not limited to the embodiments described, but is susceptible to various changes without departing from its scope.

What is claimed is:

1. A method of retrieving a bushing from a bore of a subsea wellhead assembly comprising:

a) providing a retrieval tool having a selectively extendable jack member and a selectively activatable bushing latch;

b) deploying the retrieval tool subsea on a wireline;

c) coupling the retrieval tool with the bushing using the bushing latch; and d) extending the jack member from the tool and pushing an end of the jack member against the wellhead assembly, so that the retrieval tool and the bushing are urged away from the wellhead assembly.

2. The method of claim 1, further comprising inserting a portion of the retrieval tool having the bushing latch inside the bushing.

3. The method of claim 2, wherein the bushing includes a recess on its inner surface and wherein the bushing latch is on a portion of the retrieval tool insertable into the bushing and configured to selectively extend radially outward from the retrieval tool and register with the recess, thereby coupling the retrieval tool and bushing.

4. The method of claim 1, wherein the jack member is substantially parallel with the bushing axis, extends from proximate an outer periphery of the retrieval tool, and contacts the wellhead assembly lateral to the bushing outer periphery.

5. The method of claim 4, wherein the jack member is disposed on a portion of the retrieval tool having an outer periphery that is greater than the bushing outer periphery.

6. The method of claim 1, further comprising raising the retrieval tool and bushing from subsea.

7. The method of claim 1, further comprising deploying a remotely operated vehicle (ROV) subsea and operatively coupling the ROV to the retrieval tool, wherein hydraulic pressure signals from the ROV power the jack member and the latch assembly.

8. The method of claim 1, further comprising removing a drill string from within the wellhead assembly prior to step (c).

9. The method of claim 1, wherein the bushing is temporarily retained within the bore by a ring set in grooves respectively formed on the bushing outer surface and bore inner surface and wherein the grooves are at least partially registered with one another.

10. A system for retrieving a wear bushing from within a subsea wellhead member comprising:

a retrieval tool having an upper portion attached to a wireline;

a lower portion depending from the upper portion and having an outer periphery that is smaller than an outer periphery of the upper portion and that is insertable into the wellhead member;

an elongated jack member selectively projectable from proximate the outer periphery of the upper portion into contact with an upper surface of the wellhead member; and a latch selectively extendable from the lower portion, so that when the retrieval tool is in a retrieval configuration with the lower portion inserted within the wear bushing, the latch engaged with the wear bushing, and the jack member is selectively projected from the upper portion, the jack member pushes against the wellhead member to move the retrieval tool away from the wellhead member and slide the wear bushing from within the wellhead member.

11. The system of claim 10, further comprising a remotely operated vehicle connection in communication with the latch and jack member.

12. The retrieval tool of claim 10, wherein the jack member has a diameter that is substantially the same along a length of the jack member.

* * * * *